United States Patent [19]

Rung

[11] Patent Number: 4,552,302

[45] Date of Patent: Nov. 12, 1985

[54] MAILBOX WITH INDICATOR FLAGS

[76] Inventor: Chester E. Rung, 7000 Seward Ave., Lincoln, Nebr. 68507

[21] Appl. No.: 633,847

[22] Filed: Jul. 24, 1984

[51] Int. Cl.[4] ..... A47G 29/12

[52] U.S. Cl. ..... 232/35

[58] Field of Search ..... 232/35, 37

[56] References Cited

U.S. PATENT DOCUMENTS

| | | | |
|---|---|---|---|
| 2,078,160 | 4/1937 | Reed | 232/35 |
| 2,098,242 | 11/1937 | Holmes | 232/35 |
| 2,693,314 | 11/1954 | Hunter | 232/35 |
| 2,812,130 | 11/1957 | Abell | 232/35 |
| 3,331,552 | 7/1967 | Shultz | 232/35 |
| 3,572,581 | 3/1971 | McLeod | 232/35 |
| 4,113,170 | 9/1978 | Hunsicker | 232/35 |

*Primary Examiner*—Robert P. Swiatek

*Attorney, Agent, or Firm*—Paul L. Hickman

[57] ABSTRACT

A mailbox characterized by a box provided with a hinged door, and a pair of indicator flags pivotally attached to opposing sides of the box. The indicator flags are spring loaded such that one of the flags is biased towards an upright position, and the other flag is biased towards a horizontal position. Spring loaded links are attached to each of the flags to engage a pair of studs provided on opposing sides of the mailbox door. The links are adapted to hold the flags until the door is opened, at which time the flags will rotate to their biased positions.

7 Claims, 12 Drawing Figures

MAILBOX WITH INDICATOR FLAGS

BACKGROUND OF THE INVENTION

1. Field of the Invention

This invention relates generally to mailboxes, and more particularly to mailboxes provided with indicator flags operated by the opening or closure of the mailbox door.

2. Description of the Prior Art

Mailboxes are often provided with a flag to indicate to a mail carrier that the mailbox contains correspondence. The flag usually includes a rigid post pivotally attached at one end to a side of the mailbox, and a rigid flag portion attached to the other end of the post. When the post is raised into a vertical position the flag portion is visible to the carrier and indicates that there is mail in the mailbox. After the carrier removes the mail from the mailbox, it is customary for the carrier to lower the flag as an indication that the mail has been taken.

Some mailboxes are provided with a pair of flags. One of the flags can be used to signal the carrier as described above, and the other flag can be used to signal the mail recipient that he or she has received mail. Mailboxes such as these can be very useful in rural settings where the mailbox is often located a considerable distance from the recipient's dwelling. If used properly, the two flag system can eliminate unnecessary trips.

Unfortunately, the carrier does not always have the time or inclination to properly set the signal flags on a mailbox. This can result in unnecessary and time consuming trips to the mailbox by the mail recipient.

To address this problem, a number of prior art devices have been designed to automatically set the signal flags of a mailbox. Most of these devices are actuated by the opening of the door of the mailbox.

For example, in U.S. Pat. No. 1,210,562, Taylor, a mailbox is described having an owner's signal and a carrier's signal pivotally mounted to opposing sides of the mailbox. The owner's signal is provided with means for impelling it towards its upright position, and the carrier's signal is provided with means for impelling it towards its horizontal position. Latches are provided to retain the owner's signal in a horizontal position, and the carrier's signal in a vertical position. The opening of the mailbox door releases the latches and allow the signals to reverse their positions.

A problem with Taylor's invention is that since it automatically raises the owner's signal with the opening of the mailbox, the owner may still make an unnecessary trip to an empty mailbox. Furthermore, the latch mechanism of Taylor is relatively complex and difficult for the carrier to disable the owner's signal.

Other mailboxes with automatic signal flags can be found U.S. Pat. Nos. 3,270,956 Mullner, 2,853,230 Hays, 2,475,098 Jones, and 2,670,897 Gagnon. All of these mailboxes suffer the same disadvantage as Taylor in that they include relatively complicated mechanisms which are difficult to set and reset.

SUMMARY OF THE INVENTION

An object of this invention is to provide a simplified, automatic, two flag mechanism for mailboxes.

A further object of this invention is to provide an automatic, two flag mechanism which is easily retrofitted to existing mailboxes.

Yet another object of this invention is to provide an automatic, two flag mechanism for mailboxes that has flags which can be quickly disabled by the carrier if he has no mail for the recipient.

Briefly, the invention includes a box for receiving mail, a door hinged to the box for selectively opening and closing the box, an outgoing mail flag pivotally attached to the box and biased towards a horizontal position, and an incoming mail flag pivotally attached to the box and biased towards an upright position.

The incoming mail flag and the outgoing mail flag are provided with spring loaded links which engage a pair of studs provided on the mailbox door. When the door is closed, the links hold the outgoing mail flag in an upright position and the incoming mail flag in a horizontal position. When the door is opened, the links disengage from the studs and allow the outgoing mail flag to rotate to its horizontal position and the incoming mail flag to rotate to its upright position. If, after having reclosed the door, no mail has been received, the carrier can easily rotate the incoming mail flag to its horizontal position by pulling forward on the flag until its link once again engages the stud.

An advantage of this invention is that it is easily retrofitted to existing mailboxes, and is relatively noncomplex compared to prior art designs.

Another advantage of this invention is that it is easy to set and reset the flags.

These and other objects and advantages of the present invention will no doubt become apparent upon a reading of the following descriptions and a study of the several figures of the drawing.

FIGS. *7a–7c* and *8a–8c* are right side elevations and left side elevations, respectively, of the mailbox and are used to illustrate the operation of the flags.

DETAILED DESRIPTION OF THE PREFERRED EMBODIMENT(S)

Figure 1:
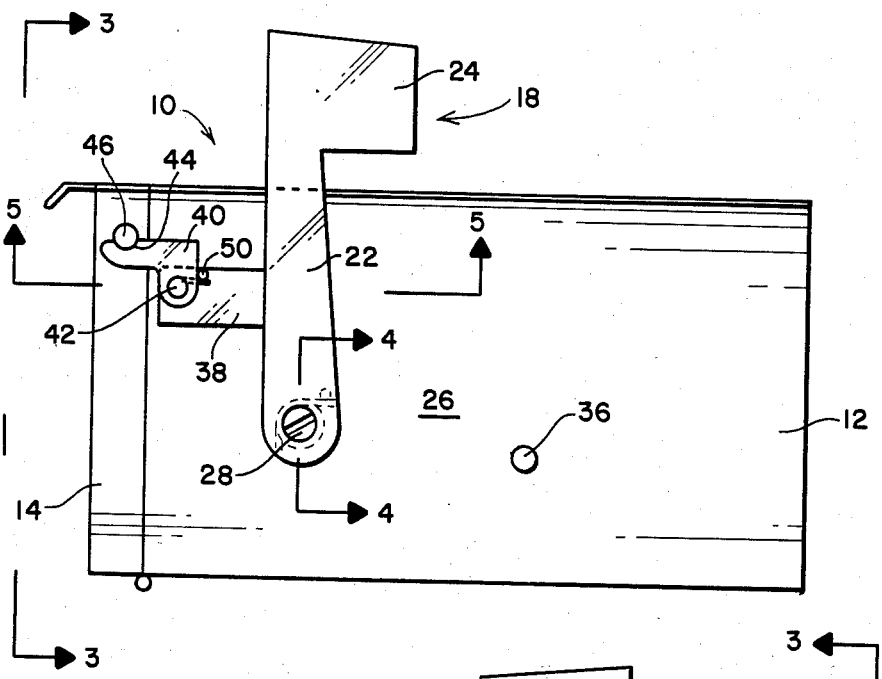
FIG. 1 is a right side elevation of a mailbox with indicator flags in accordance with the present invention.
Figure 2:
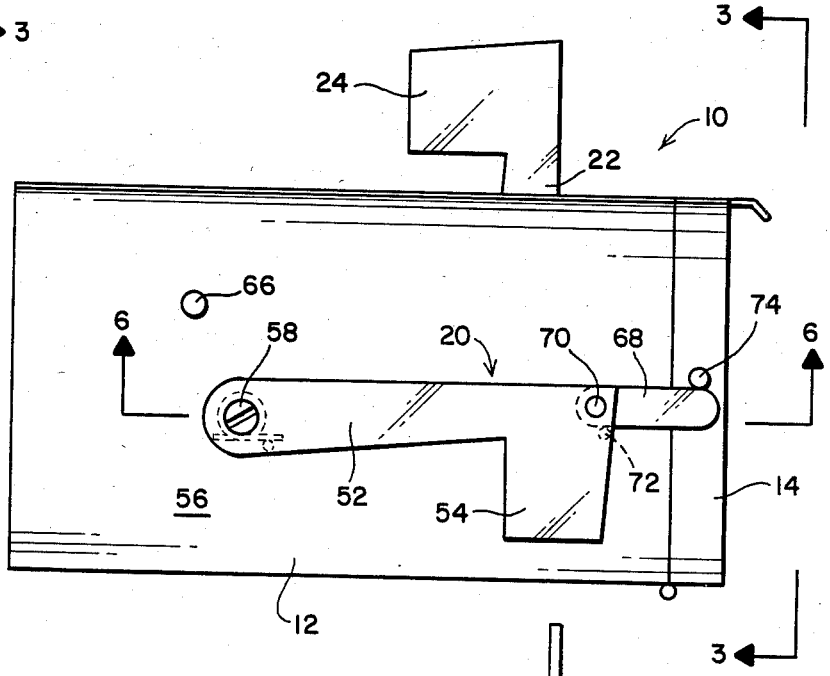
FIG. 2 is a left side elevation thereof.
Figure 3:
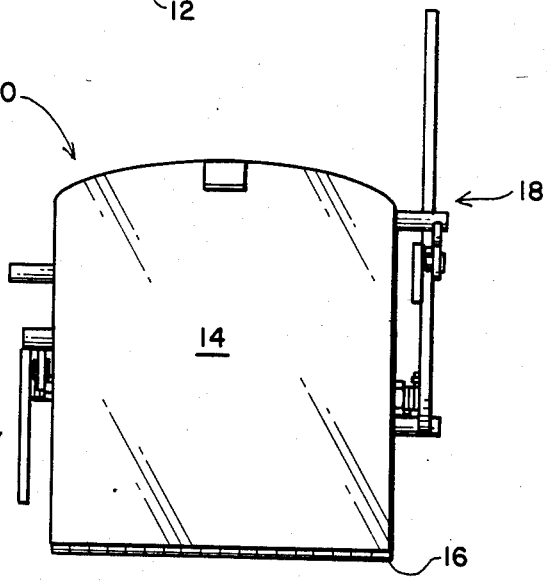
FIG. 3 is a front elevation thereof as seen from lines 3—3 of FIGS. 1 and 2.

Referring to FIGS. 1–3, a mailbox 10 in accordance with the present invention includes a box 12, a door 14 attached to the box 12 by a hinge 16, an outgoing mail flag assembly 18, and an incoming mail flag assembly 20. Outgoing mail flag assembly 18 and incoming mail flag assembly 20 are designed to be attached to an existing box 12 and door 14, but may also be provided at the time of the original manufacture of the mailbox 10.

Box 12 is shown in its standard configuration having a substantially square, tubular body which is closed at one end and open at its other end. The door 14 is configured to selectively cover and uncover the open end of box 12.

Figure 4:
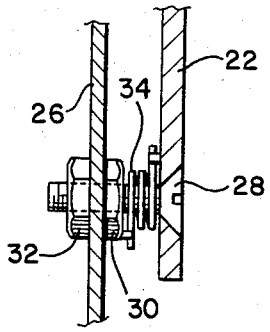
FIG. 4 is a cross section taken along line 4—4 of FIG. 1.

Referring now to FIGS. 1 and 4, the outgoing mail flag assembly includes a post 22 and a flag portion 24, which is preferably painted in a high visibility color. An end of post 22 is rotatably coupled to a side portion 26 of box 12 by means of a screw 28 and a pair of nuts 30 and 32. A spiral spring 34 engages post 22 and nut 30, and biases the post 22 towards a horizontal position. A stud 36 is attached to side portion 26 to limit the rotation of post 22 past its substantially horizontal position.

Figure 5:
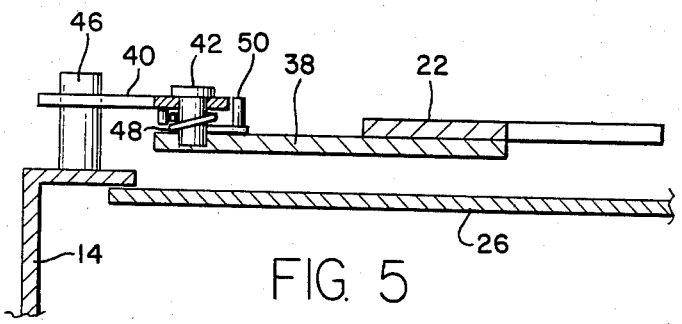
FIG. 5 is a cross section taken along line 5—5 of FIG. 1.

With reference to FIGS. 1 and 5, an arm 38 is attached to post 22 at substantially right angles relative thereto. An L shaped link 40 has its shorter leg pivotally attached to arm 38 by a pivot pin 42, and is provided with a cupped surface 44 at its longer leg which is adapted to engage the under surface of a stud 46 attached to door 14. A spiral spring 48 biases link 40 against a stop 50 attached to arm 38.

Figure 6:
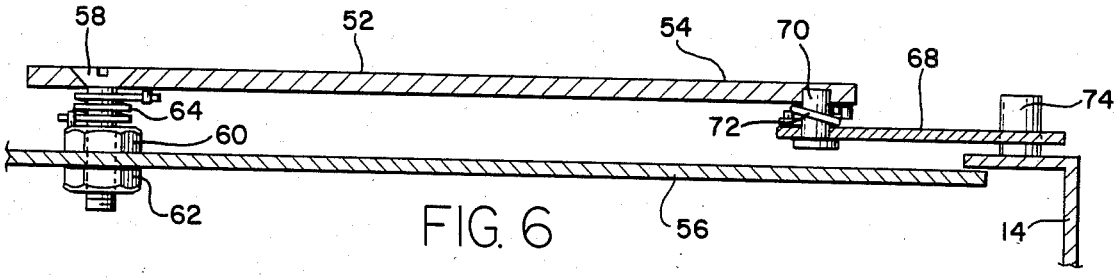
FIG. 6 is a cross section taken along line 6—6 of FIG. 2.
Figure 7A:
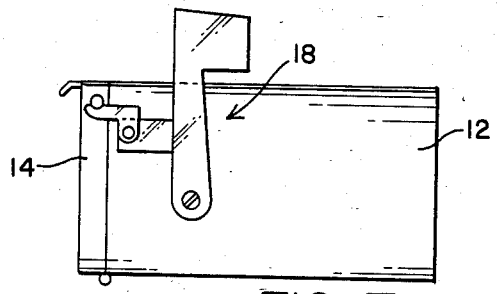
Figure 8A:
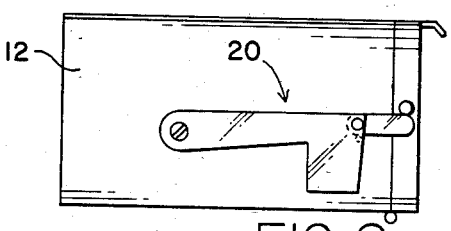
Figure 7B:
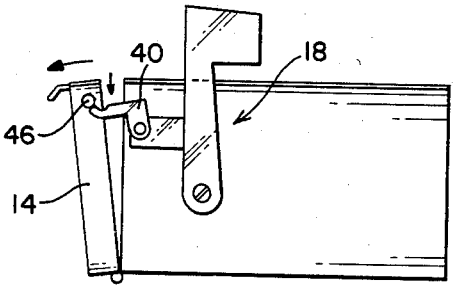
Figure 8B:
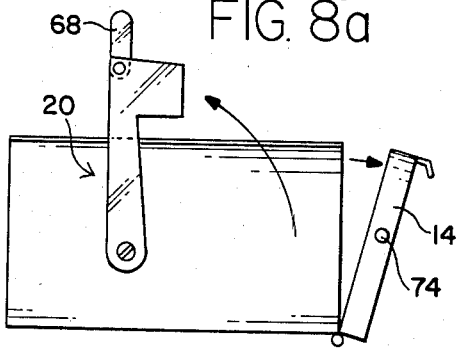
Figure 7C:
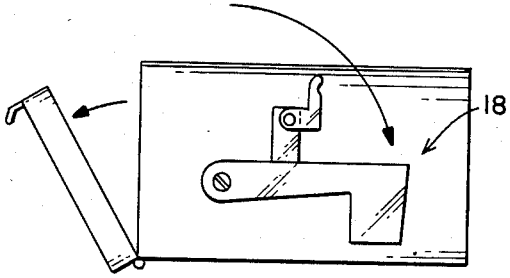
Figure 8C:
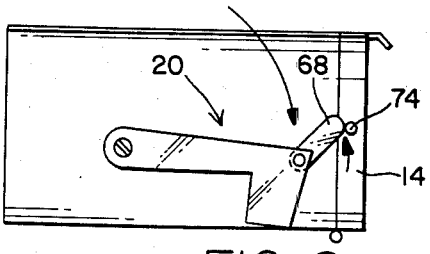

In FIGS. 2 and 6, incoming mail flag assembly 20 includes a post 52 and a flag portion 54 which, again, is preferably painted in a high visibility color. An end of post 52 is rotatably coupled to a side portion 56 of box 12 by means of a screw 58 and a pair of nuts 60 and 62. A spiral spring 64 engages post 52 and nut 60 to bias post 52 towards a substantially vertical, upright position. A stud 66 is attached to side portion 56 to limit the rotation of post 52 past its vertical position.

A straight link is pivotally attached to flag portion 54 by a pivot pin 70. A spiral spring 72 engages flag portion 54 and link 68 and biases the link 68 against a stop 72 attached to flag portion 54. A surface of link 68 proximate its free end is adapted to engage a lower surface of a stud 74 attached to door 14.

The operation of the present invention will be discussed with reference to FIGS. *7a–7c* and FIGS. *8a–8c*. Referring first to FIG. *7a*, the outgoing mail flag assembly 18 is shown in its substantially vertical position to indicate that the box 12 contains mail. Flag assembly 18 is set in this position by the mail recipient by simply closing door 14 and manually rotating the flag assembly to its upright position. In FIG. *7b*, as door 14 is opened by the mail carrier, spring loaded link 40 disenqages from stud 46 to allow the flag assembly 18 to rotate to its substantially horizontal position as shown in FIG. *7c*.

In FIG. *8a*, incoming mail flag assembly 20 is shown in its substantially horizontal position to indicate that there is no incoming mail within box 12. When door 14 is opened as illustrated in FIG. *8b*, link 68 disengages from stud 74 to allow the flag assembly 18 to rotate to its substantially vertical position.

As seen in FIG. *8c*, the incoming mail flag assembly is set into its horizontal position by first closing door 14 and then rotating the flag assembly until link 68 snaps past stud 74. It should be noted that if the postal carrier retrieves mail from box 12, but has no mail for the recipient, it would be a simple matter for him to rotate the incoming mail flag assembly to its horizontal position, indicating that the box is empty.

While this invention has been described in terms of a few preferred embodiments, it is contemplated that persons reading the preceding descriptions and studying the drawing will realize various alterations, permutations and modifications thereof. It is therefore intended that the following appended claims be interpreted as including all such alterations, permutations and modifications as fall within the true spirit and scope of the present invention.

What is claimed is:

1. A mailbox apparatus comprising:

an elongated enclosure provided with an opening through which mail may be inserted and removed;

a door hinged to said enclosure to selectively cover and uncover said opening, said door being closed when said opening is substantially covered and opened when said opening is substantially unobstructed;

a first elongated indicator flag pivotally attached to a first side portion of said enclosure, said first indicator flag being pivotable between a non-vertical position and a substantially vertical position;

means biasing said first indicator flag towards said substantially vertical position;

a stop attached to said first side portion of said enclosure to prevent said first indicator flag from rotating past said substantially vertical position;

means for retaining said first indicator flag in said non-vertical position when said door is closed including a first stud attached to said door, a first link pivotally attached to said first indicator flag and engagable with said first stud, a stop attached to said first indicator flag to limit the rotation of said first link, and means biasing said first link towards said stop, said first link being a substantially straight, elongated member pivotally attached at one end to said first indicator flag such that its other end may engage a lower surface of said first stud when said door is closed;

a second elongated indicator flag pivotally attached to a second side portion of said enclosure, said second indicator flag being pivotable between a non-vertical position and a substantially vertical position; and means biasing said second indicator flag towards said non vertical position, and means for retaining said second indicator flag in said vertical position when said door is closed;

whereby the opening of said door causes said first indicator flag to pivot to said substantially vertical position and said second indicator flag to pivot to said substantially non-vertical position.

2. A mailbox apparatus as recited in claim 1 further including a stop attached to said second side portion of said enclosure to prevent said second indicator flag from rotating past said non-vertical position.

3. A mailbox apparatus comprising:

an elongated enclosure provided with an opening through which mail may be inserted and removed;

a door hinged to said enclosure to selectively cover and uncover said opening, said door being closed when said opening is substantially covered and opened when said opening is substantially unobstructed;

a first elongated indicator flag pivotally attached to a first side portion of said enclosure, said first indicator flag being pivotable between a non-vertical position and a substantially vertical position;

means biasing said first indicator flag towards said substantially vertical position, and means for retaining said first indicator flag in said non-vertical position when said door is closed;

a second elongaged indicator flag pivotally attached to a second side portion of said enclosure, said second indicator flag being pivotable between a non-vertical position and a substantially vertical position;

means biasing said second indicator flag towards said non-vertical position, and means for retaining said second indicator flag in said vertical position when said door is closed including a second stud attached to said door, and a second link pivotally coupled to said second indicator flag and engagable with said second stud; and a stop attached to said second side portion of said enclosure to prevent said second indicator flag from rotating past said non-vertical position;

whereby the opening of said door causes said first indicator flag to pivot to said substantially vertical position and said second indicator flag to pivot to said substantially non-vertical position.

4. A mailbox apparatus as recited in claim 3 wherein said means for retaining said second indicator flag in said vertical position further includes an arm extending from said second indicator flag, and pivot means attaching said second link to said said arm.

5. A mailbox apparatus as recited in claim 4 wherein said means for retaining said second indicator flag further includes a stop attached to said arm to limit the rotation of said second link, and means for biasing said second link against said stop.

6. A mailbox apparatus as recited in claim 5 wherein said second link is a substantially L shaped member having one leg pivotally attached to said arm such that its other end may engage a lower surface of said second stud when said door is closed.

7. A mailbox apparatus comprising:

an elongated enclosure provided with an opening through which mail may be inserted and removed;

a door hinged to said enclosure to selectively cover and uncover said opening, said door being closed when said opening is substantially covered and opened when said opening is substantially unobstructed;

a first elongated indicator flag pivotally attached to a first side portion of said enclosure, said first indicator flag being pivotable between a non-vertical position and a substantially vertical position;

a stop attached to said first side portion of said enclosure to prevent said first indicator flag from rotating past said substantially vertical position;

means biasing said first indicator flag towards said substantially vertical position;

means for retaining said first indicator flag in said non-vertical position when said door is closed including a first stud attached to said door, a first link pivotally attached to said first indicator flag and engagable with said first stud, a stop attached to said first indicator flag to limit the rotation of said first link, and means biasing said first link towards said stop attached to said first indicator flag;

a second elongated indicator flag pivotally attached to a second side portion of said enclosure, said second indicator flag being pivotable between a non-vertical position and a substantially vertical position;

means biasing said second indicator flag towards said non-vertical position; and means for retaining said second indicator flag in said vertical position when said door is closed, including a second stud attached to said door, and a second link pivotally coupled to said second indicator flag and engagable with said second stud;

whereby the opening of said door causes said first indicator flag to pivot to said substantially vertical position and said second indicator flag to pivot to said substantially non-vertical position.

* * * * *